United States Patent [19]

Cherny

[11] 4,362,293

[45] Dec. 7, 1982

[54] CUPOLA

[76] Inventor: Anatoly A. Cherny, ulitsa Slavy, 7, kv. 40, Penza, U.S.S.R.

[21] Appl. No.: 235,393

[22] Filed: Feb. 18, 1981

[30] Foreign Application Priority Data

Aug. 23, 1979 [SU] U.S.S.R. ..... 2810462

[51] Int. Cl.[3] ..... F27D 1/08

[52] U.S. Cl. ..... 266/219; 75/43; 266/900

[58] Field of Search ..... 75/43, 44 R, 44 S; 266/900, 219

[56] References Cited

U.S. PATENT DOCUMENTS 2,495,264 1/1950 Kreuler ..... 266/219

3,802,678 4/1974 Taft et al. ..... 266/219

*Primary Examiner*—M. J. Andrews

*Attorney, Agent, or Firm*—Ladas & Parry

[57] ABSTRACT

A cupola comprises a shaft with burners located at the bottom part around the periphery thereof, the burners having nozzle ducts. The cupola further comprises a hearth and a refractory bed. The total outlet cross-sectional area (Σf) of the nozzle ducts is equal to 0.02–0.18 of the shaft cross-sectional area (F) in the plane of location of the nozzle ducts.

2 Claims, 2 Drawing Figures

CUPOLA

TECHNICAL FIELD

This invention relates to metallurgical and building material industries and has particular reference to cupolas.

The invention may be used with particular advantage in melting equipment designed for melting cast iron in foundry and metallurgy and melting mineral materials in producing slag and mineral wool.

BACKGROUND ART

It has been known recently to widely use melting equipment operating on gaseous fuel, more particularly, natural gas. When melting of cast iron is done by the use of natural gas, the metal is not saturated with noxious sulphur admixtures and the strength of iron castings is increased since there is no detrimental slag inclusions inherent in melting on coke.

Furthermore, the simplicity of natural gas transport and the high combustion heat of natural gas are of substantial importance. The use of natural gas as a fuel reduces air pollution.

Owing to the aforementioned advantages of natural gas and the growing scarcity of coke, melting of cast iron and silicates on natural gas is becoming widely accepted.

Known in the art is a gas cupola comprising a shaft with built-in gas burners and further comprising water-cooled partitions dividing the shaft into two parts, viz. an upper melting chamber and a lower superheating chamber. The water-cooled partitions are provided with a packing of high melting and heat resistant materials (see U.S.S.R. Inventor's Certificate No. 503107, F 27B 1/08, published in 1976).

However this cupola suffers from the disadvantage that molten materials adhere to the water-cooled partitions, which causes drop in the temperature of the melt, reduction of the passages for the movement of the hot gas and the melt between the water-cooled partitions, and increase of heat losses due to heating of the water in the partitions.

Another drawback is the lower superheating chamber which is not filled with a refractory packing and causes heavy heat losses through the walls, thereby decreasing the cupola efficiency and causing lack of the melting temperature.

A still further drawback is that the cupola construction under consideration hampers removal of refractory packing and unmolten materials from the shaft after the melting process and complicates repair of the lining and preparation of the cupola for melting.

Also known in the art is a cupola which is designed for melting cast iron on a refractory packing in the shaft and comprises horizontal-duct burners in the cupola bottom part (see the book by Girshovich N. G. "Iron Casting" published by Metallurgizdat in 1949, pages 633–635, 642–644,654–656).

This cupola suffers from the disadvantage that during operation thereof the burner ducts become blocked with slag molten refractories, the melting process being thereby disturbed. The refractory packing in this cupola is heated unevenly and the gaseous products of combustion poorly penetrate into the refractory packing, owing to which the temperature of the molten material decreases and the quality of castings is adversely affected.

Also known in the art is a gas cupola, which is the prototype of this invention comprising a shaft with burners radially equispaced around the periphery of the cupola bottom part (see the book by I. M. Rafalovich "Natural Gas as Fuel for Metallurgical Furnaces", published by Gosudarstvennoye Nauchno-Tekhnicheskoye Isdatelstvo po Chornoi i Tsvetnoy Metallurgii in 1961, Moscow, pages 150–151).

The cupola in question operates on natural gas and preheated air. The column of the charge materials is supported by a bed of natural corundum and gas is burnt in a corundum packing. However, durability of corundum is insufficient. During prolonged operation the combustion process becomes upset and gas is not uniformly distributed in the refractory bed, whereby the melting process is disturbed and frequently discontinued.

SUMMARY OF THE INVENTION

It is the primary object of the present invention to stabilize a combustion process.

It is another object of the present invention to achieve uniform distribution of gases in a refractory bed.

It is still another object of the present invention to raise the temperature of the final product.

According to these and other objects, the invention provides a cupola comprising a shaft with burners which have nozzle ducts and are situated at the shaft bottom around the periphery thereof, and further comprising a hearth and a refractory bed, the total outlet cross-sectional area (f) of the nozzle ducts being equal to 0.02–0.18 of the shaft cross-sectional area (F) in the plane of location of the nozzle ducts.

This constructional arrangement of the cupola provides for uniform distribution of gases among the gas burners, the nozzle ducts of the burners, and in the refractory bed, and stabilizes the combustion process on the whole.

If the total outlet cross-sectional area of the nozzle ducts exceeds 0.18 of the shaft cross-sectional area in the plane of location of the nozzle ducts, then distribution of gases among the gas burner, the burner nozzle ducts, and in the refractory bed is not uniform, which adversely affects stability of gas combustion in the layer of lump materials, and undue droning and whistling noises are produced at both high and low rates of consumption of the gas-air mixture. Furthermore, the temperature in the layer of lump materials is insufficient and uneven, owing to which the melting process is upset and discontinued.

If the total outlet cross-sectional area of the nozzle ducts is less than 0.02 of the shaft cross-sectional area in the plane of location of the nozzle ducts, flame breaks away from the burner nozzle ducts and gases burn above the layer of lump materials instead of therein, which upsets the melting process and destroys the performance of the cupola.

In the cupola of the present invention, the outlet cross-sectional area (f) of each nozzle duct is chosen such that the distances ($h_1$, $h_2$) from the nozzle duct lower edge to the cupola hearth and from the nozzle duct upper edge to the top level of the refractory bed are respectively (0.8 to 7.0)d and (2 to 16)d, where d is the diameter of a circle whose area is equal to said outlet cross-sectional area (f) of the nozzle duct.

The parameter d is independent of the shape of the burner nozzle duct outlet section, but it depends on the duct outlet cross-sectional area, since this area determines the diameter of the gas flow outside the duct. If the duct outlet section is round, then d is the diameter of the sectional area.

With the cupola construction in accordance with the aforesaid optimum data, high temperature is achieved at the top level of the refractory bed and at the hearth, durability of the refractory bed is ensured, and the possibility of melt freezing on the hearth is eliminated.

The aforesaid values are rational within $0.8d \leqq h_1 \leqq 7d$, $2d \leqq h_2 < 16d$ and other optimum conditions because at $h < 0.8d$ the gas-air mixture does not ignite at the hearth surface and does not heat the hearth, whereas at $h > 7d$ the gas-air mixture does not reach the hearth surface and, therefore, said surface is not heated either. In both cases the melt freezes on the hearth and in the tap hole, the melt level rises, the burner nozzle ducts become filled with the melt, and the melting process is aborted. At $h_2 < 2d$ and $h_2 > 16d$ the temperature at the top level of the refractory bed lowers, which also causes reduction of the melt temperature, freezing of the melt in the refractory bed, and abortion of the melting process.

It is also necessary that the plane of location of the burner nozzle ducts and the shaft cross section should constitute a circle and the ratio of the perimeter (L) of this circle to the distance (l) between the centres of the outlet sections of adjacent nozzle ducts should be:

$$\text{from } \frac{2.327[(R - 4.22B)^2 + (1.35B)^2]0.5}{B} \text{ to } \frac{3.452[(R - 2.85B)^2 + (0.91B)^2]0.5}{B},$$

where

R = radius of the shaft in the plane of location of the nozzle ducts;

B = maximum dimension of nozzle duct outlet section (height, width, diameter).

This constructional arrangement of the cupola provides for stabilized combustion of gases in the shaft at the outlet sections of the nozzle ducts, stable ignition of the gas-air mixture from flame to flame, and intensive shaft heating at the nozzle ducts and the refractory bed.

If the ratio of the circle perimeter (I) to the distance (l) between the centres of the outlet sections of adjacent nozzle ducts is greater than $$\frac{3.452[(R - 2.85B)^2 + (0.91B)^2]0.5}{B},$$

then the combustion process is upset on the whole, inasmuch as the gas ignites and burns far from the burner nozzle ducts.

If the ratio of the circle perimeter (L) to the distance (l) between the centers of the outlet sections of adjacent nozzle ducts is less than $$\frac{2.327[(R - 4.22B)^2 + (135B)^2]0.5}{B},$$

then the gas ignites at the burner nozzle ducts, but ignition of the gas-air mixture does not proceed from flame to flame all the way around, there being missing nozzle ducts, owing to which the shaft is insufficiently heated between the nozzle ducts, the combustion process is upset and the melting process gradually ceases.

BRIEF DESCRIPTION OF THE DRAWINGS

The invention will now be more particularly described by way of example with reference to the accompanying drawings, wherein.

DETAILED DESCRIPTION OF THE INVENTION

Figures 1, 2:
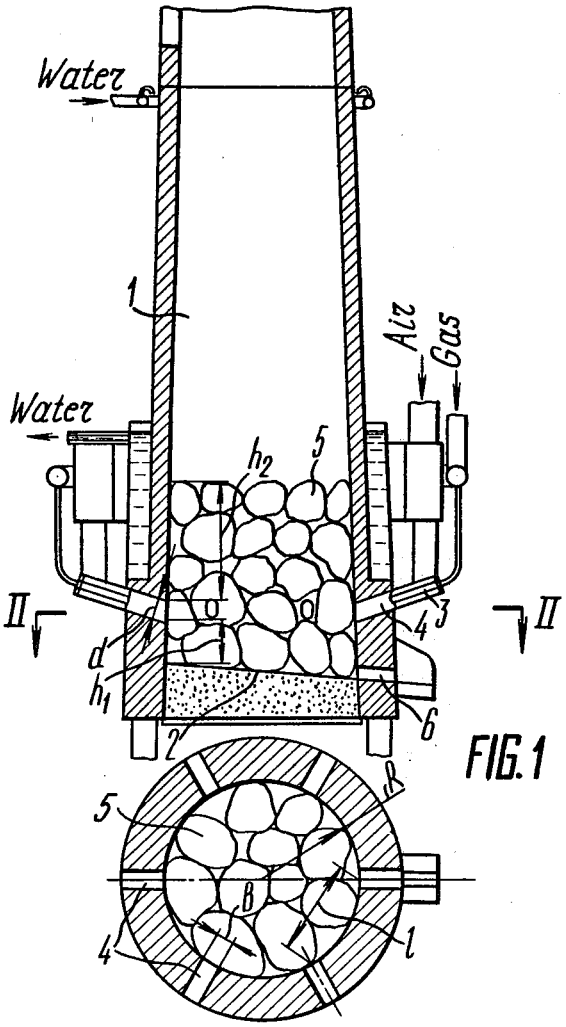
FIG. 1 diagrammatically shows a general view of a cupola according to the invention, in longitudinal section.
FIG. 2 is a section on the line II—II of FIG. 1.

The cupola comprises a shaft 1, in the bottom part of which, above a hearth 2, are situated gas burners 3 with nozzle ducts 4, and further comprises a refractory bed 5 loaded in the shaft 1 after lighting up the burners 3, and a tap hole 6 for discharging the molten material.

The total outlet cross-sectional area of the nozzle ducts is equal to 0.2–0.18 of the shaft cross-sectional area in the plane of location of the nozzle ducts.

This constructional arrangement of the cupola provides for uniform distribution of gases and stabilized combustion thereof in the layer of a lump material.

The shape of the outlet section of the nozzle ducts may be round, elliptical, oval, rectangular or square, depending on the construction of the cupola and its burners. On the other hand, the construction of the cupola depends on the purpose thereof and layout considerations. For example, for melting silicates, use is made of a cupola with a round-section shaft which provides optimum conditions for deep penetration of gases into the refractory bed, whereby the temperature of the molten material is raised and the possibility of the melt freezing on the hearth is eliminated. For melting cast iron, it is expedient to use a rectangular section cupola shaft which simplifies lining problems.

The outlet cross-sectional area (f) of each nozzle duct is chosen such that the distances ($h_1$, $h_2$) from the nozzle duct lower edge to the cupola hearth and from the nozzle duct upper edge to the top level of the refractory bed are respectively (0.8 to 7.0) d and (2 to 16)d, where d is the diameter of a circle whose area is equal to said outlet cross-sectional area (f) of the nozzle duct.

Owing to this constructional arrangement of the cupola, high temperature is achieved at the top level of the refractory bed and at the hearth, durability of the refractory bed is ensured, and the possibility of the melt freezing on the hearth is eliminated.

It is necessary that in the cupola of the present invention the plane of location of the burner nozzle ducts and the shaft cross section constitute a circle and the ratio of the perimeter (L) of this circle to the length (l) between the centres of the outlet sections of adjacent nozzle ducts should be:

$$\frac{2.327[(R-4.22B)^2+(1.35B)^2]0.5 \text{ to } 3.452[(R-2.85B)^2+(0.91B)^2]0.5}{B}$$

This constructional arrangement of the cupola provides for stabilized combustion of gases in the shaft at the outlet sections of the nozzle ducts, stable ignition of the gas-air mixture from flame to flame, burning at every nozzle duct, and intensive shaft heating at the nozzle ducts and the refractory bed.

First the burners are lighted up by means of wood or an igniter. For this purpose, air is fed at a low rate through the burners 3 and the nozzle ducts 4 (either in succession or simultaneously) and then the fuel (for example, a natural gas) is fed.

Flame combustion of gas is originated in the shaft 1 above the hearth 2, there being a flame from each nozzle duct 4. The flames heat the lining at the bottom of the shaft 1 to a temperature of 1500°-1650° C., whereupon the shaft is charged with refractories forming the bed 5 which usually consists of lumps and also such materials as bricks, tubes, balls (chamotte, high-alumina, carbon-bearing refractories with a melting point above that of the materials being molten and overheated).

After the temperature of the refractory bed 5 is raised to 1500°-1650° C., the shaft is filled with a charge of various silicates, slag, broken building bricks and limestone. The charge melts on the refractory bed 5, the molten material flows down the lumps of the refractory bed 5, overheats, gets onto the hearth 2 and flows thereon to the tap hole 6 and out. Outside the shaft the liquid slag is blast-treated and turns into slag wool. To maintain constant height of the refractory bed 5, the charge is supplemented with some amount of refractories corresponding in composition to the refractory bed.

The cupola may be used for roasting limestone and melting cast iron, other metals, alloys and nonmetals, for example, stone casting materials.

What is claimed is:

1. A cupola comprising:

a shaft;

a plurality of burners, each burner having an outlet, said outlets being situated around the periphery of the bottom part of said shaft;

a plurality of nozzle ducts, each of which ducts is connected to the outlet of a respective burner, each duct having an outlet situated about a plane of a cross-section of said shaft;

a hearth positioned at the bottom of said shaft; and a refractory bed located above said hearth;

wherein the total outlet cross-sectional area of the nozzle ducts ($\Sigma f$) is equal to from 0.02 to 0.18 of the cross-sectional area of said shaft (F) in said plane of location of the nozzle ducts, and the outlet cross-sectional area (f) of each nozzle duct is chosen such that the distances ($h_1$, $h_2$) from the nozzle duct lower edge to the cupola hearth and from the nozzle duct upper edge to the top level of the refractory bed are respectively (0.8 to 7.0)d and (2 to 16)d where "d" is the diameter of a circle whose area is equal to said outlet cross-sectional area (F) of the nozzle duct.

2. A cupola as claimed in claim 1, wherein the plane of location of the nozzle ducts and the shaft cross section constitute a circle and the ratio of the perimeter (L) of this circle to the distance (l) between the centers of the outlet sections of adjacent nozzle ducts are:

$$\frac{2.327[(R-4.22B)^2+(1.35B)^2]0.5}{B} \text{ to } \frac{3.452[(R-2.85B)^2+(0.91B)^2]0.5}{B},$$

where

R = radius of the shaft in the plane of location of the nozzle ducts;

B = maximum dimension of nozzle duct outlet section (height, width, diameter).

* * * * *